US009414680B2

(12) United States Patent
Su

(10) Patent No.: US 9,414,680 B2
(45) Date of Patent: Aug. 16, 2016

(54) FLEXIBLE TILT ADJUSTMENT DEVICE FOR A CHAIR BACK

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 224 days.

(21) Appl. No.: 14/248,357

(22) Filed: Apr. 9, 2014

(65) Prior Publication Data

US 2015/0289660 A1 Oct. 15, 2015

(51) Int. Cl.
*A47C 1/032* (2006.01)

(52) U.S. Cl.
CPC ..... *A47C 1/03272* (2013.01); *A47C 1/03266* (2013.01)

(58) Field of Classification Search
USPC ..... 297/301.7, 301.6, 300.3
See application file for complete search history.

(56) References Cited

U.S. PATENT DOCUMENTS

| | | | | | |
|---|---|---|---|---|---|
| 4,123,103 | A * | 10/1978 | Doerner | A47C 3/026 | 297/301.4 |
| 4,695,093 | A * | 9/1987 | Suhr | A47C 1/03255 | 297/302.4 |
| 7,014,262 | B2 * | 3/2006 | Rossetto | A47C 1/03238 | 297/300.8 |
| 7,367,622 | B2 * | 5/2008 | Roslund | A47C 1/03222 | 297/300.4 |
| 7,614,697 | B1 * | 11/2009 | Lai | A47C 1/03255 | 297/301.1 |
| 8,602,493 | B1 * | 12/2013 | Chen | A47C 7/022 | 297/284.9 |
| 2006/0202530 | A1 * | 9/2006 | Lin | A47C 1/03238 | 297/300.1 |
| 2007/0057552 | A1 * | 3/2007 | Roslund | A47C 1/03222 | 297/292 |

* cited by examiner

*Primary Examiner* — David E Allred

(57) ABSTRACT

The adjustment device includes a seat connected to a back by a first rod and an elasticity set. The elasticity has a base connected to the first rod. A pressing rod is connected to the base. A first spring is passed through by the pressing rod and stopped by the base. A pushing block is connected to the pressing rod and the first spring. A rotating rod passes through the seat. Two pressing blocks with a threaded hole are passed by the rotating rod and separately screwed with the rotating rod. Two second springs are passed through by the rotating rod and nipped between the pressing blocks and the edge plates.

10 Claims, 7 Drawing Sheets

FLEXIBLE TILT ADJUSTMENT DEVICE FOR A CHAIR BACK

BACKGROUND OF THE INVENTION

1. Technical Field

The invention relates to chairs, particularly to back tilt adjustment of chairs.

2. Related Art

Some office chairs are provided with a back tilt adjustment function. Such a function is typically accomplished by a spring between a cushion and a back. However, this spring tends to elastic fatigue.

Some chairs adopt a flexible tilt adjustment structure as shown in FIG. 1. The structure is fixed to a seat 61 through an adjustment rod 60. An end of the adjustment rod 60 connects a driving block 62. The seat 61 is provided with a transmission rod 63. The transmission rod 63 is pivotally connected to the driving block 62. A spring 64 is passed by the transmission rod 63. The seat 61 is provided with a sway element 66 connected to a back. The sway element 66 is pushed by the spring 64. Thus the back can be adjusted by moving the transmission rod 63 flexibly pushed by the spring 64.

In above structure, rotating the adjustment rod 60 to move the transmission rod 63 by hand needs a larger force. This causes inconvenience in operation. The adjustment rod 60 and transmission rod 63 need a link set 65 to change the direction of force. When the link set 65 has jammed, the whole adjustment structure cannot work. Furthermore, the single-sided transmission from the link set 65 to the transmission rod 63 is easy to be unbalanced. This will cause damage of the transmission rod 63.

SUMMARY OF THE INVENTION

An object of the invention is to provide a flexible back tilt adjustment device, which can adjust back tilt without effort.

To accomplish the above object, the back tilt adjustment device of the invention includes a seat connected to a back by a first rod and an elasticity set. The elasticity has a base connected to the first rod. A pressing rod is connected to the base. A first spring is passed through by the pressing rod and stopped by the base. A pushing block is connected to the pressing rod and the first spring. A rotating rod passes through the seat. Two pressing blocks with a threaded hole are passed by the rotating rod and separately screwed with the rotating rod. Two second springs are passed through by the rotating rod and nipped between the pressing blocks and the edge plates.

DETAILED DESCRIPTION OF THE INVENTION

Figure 1:
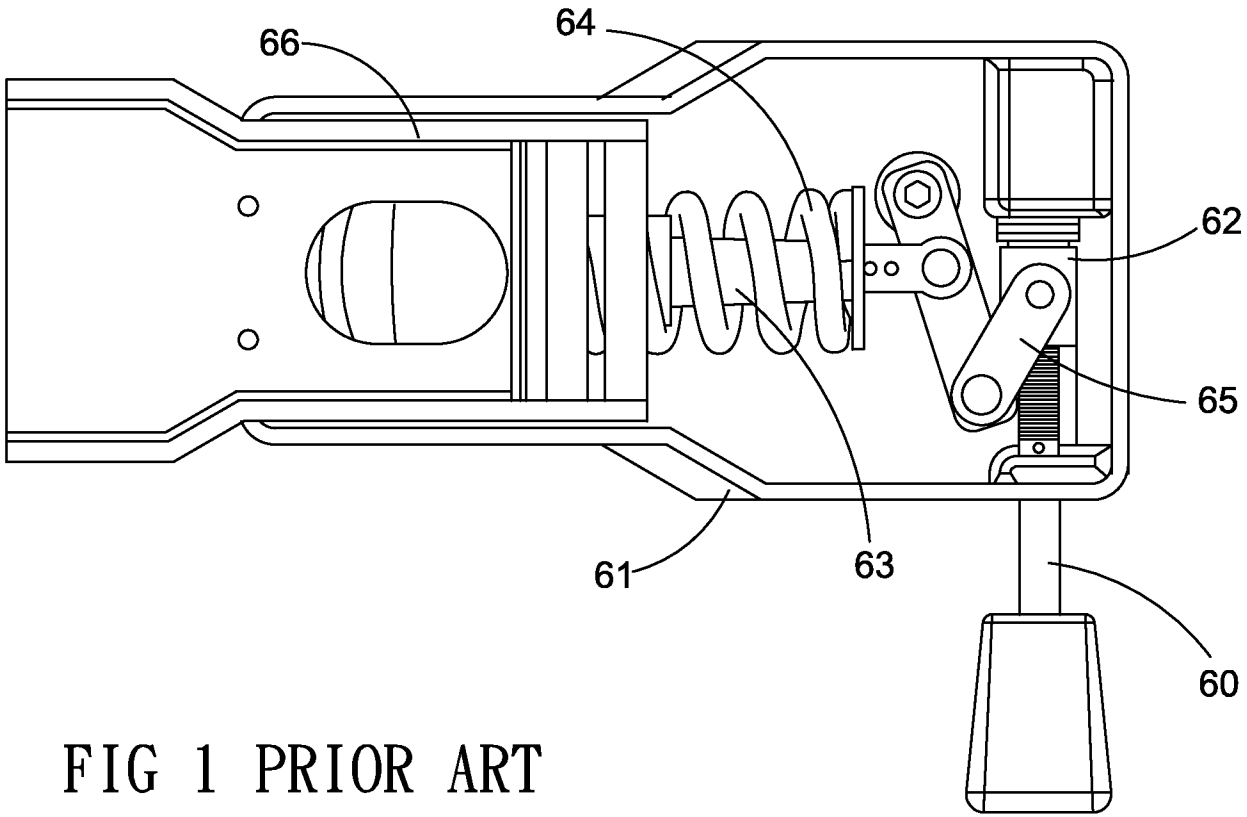
FIG 1 PRIOR ART
FIG. 1 is a schematic view of a conventional back tilt adjustment structure.
Figure 2:
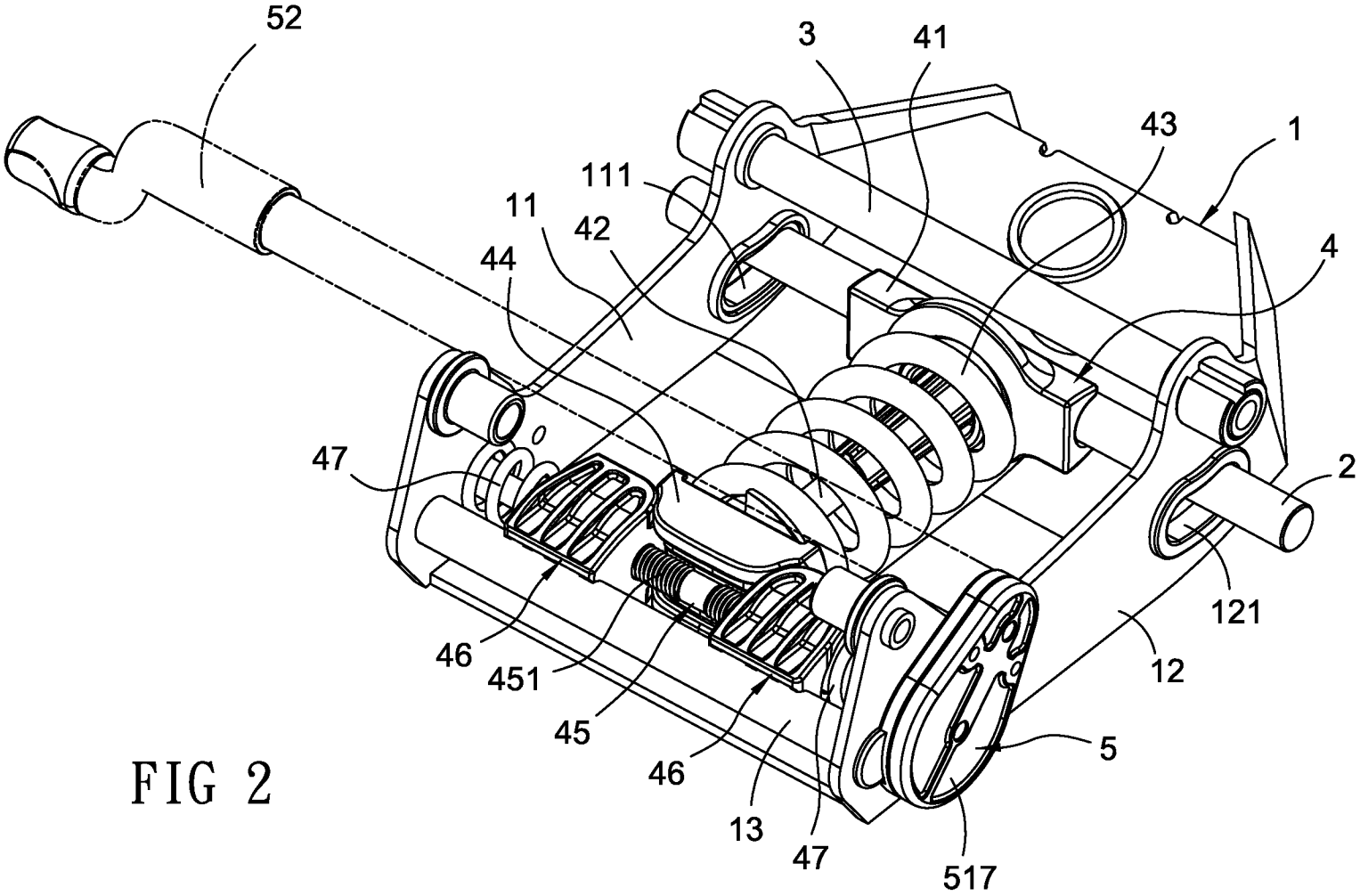
FIG. 2 is a perspective view of the invention.
Figure 3:
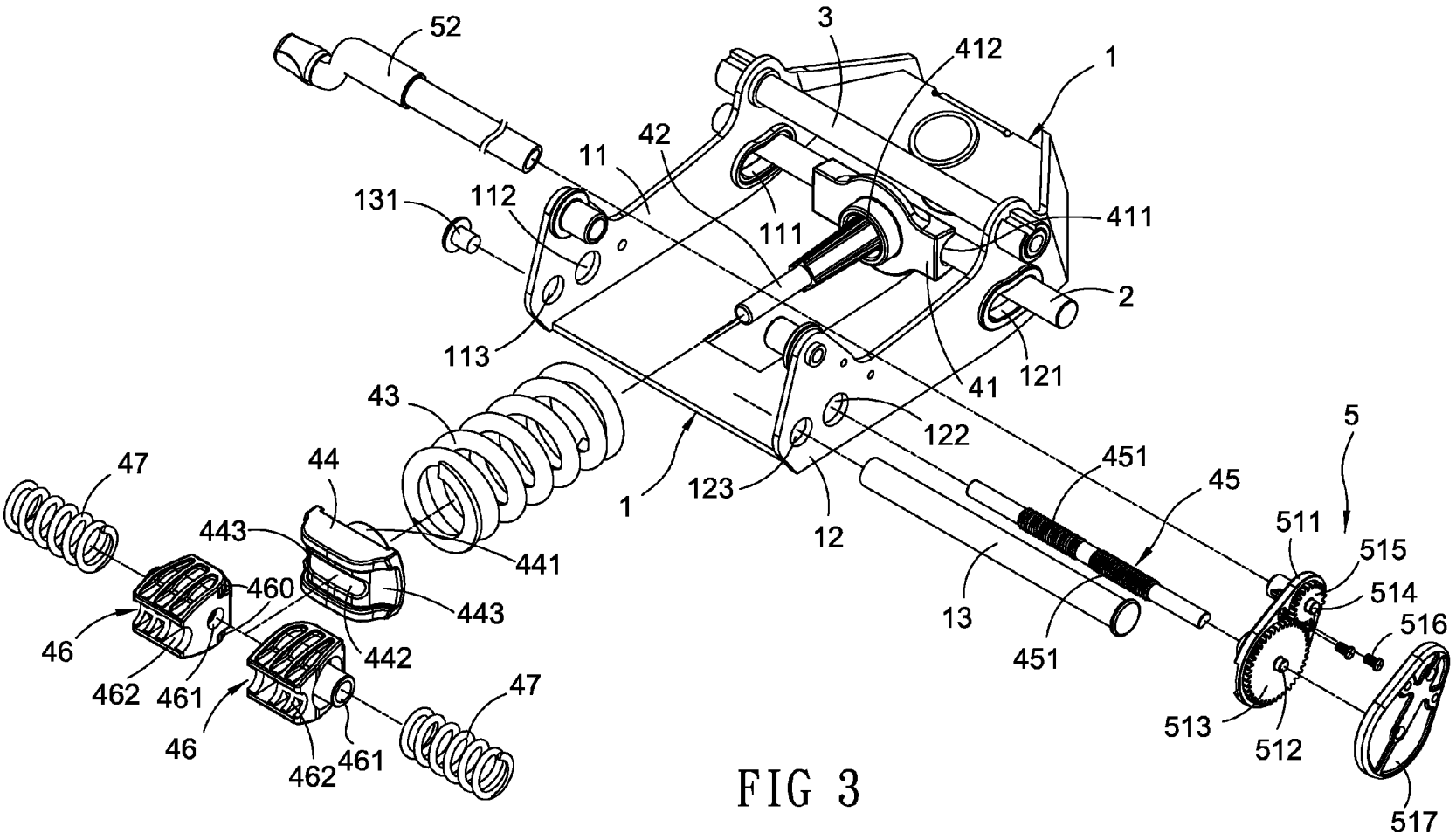
FIG. 3 is an exploded view of the invention.
Figure 4:
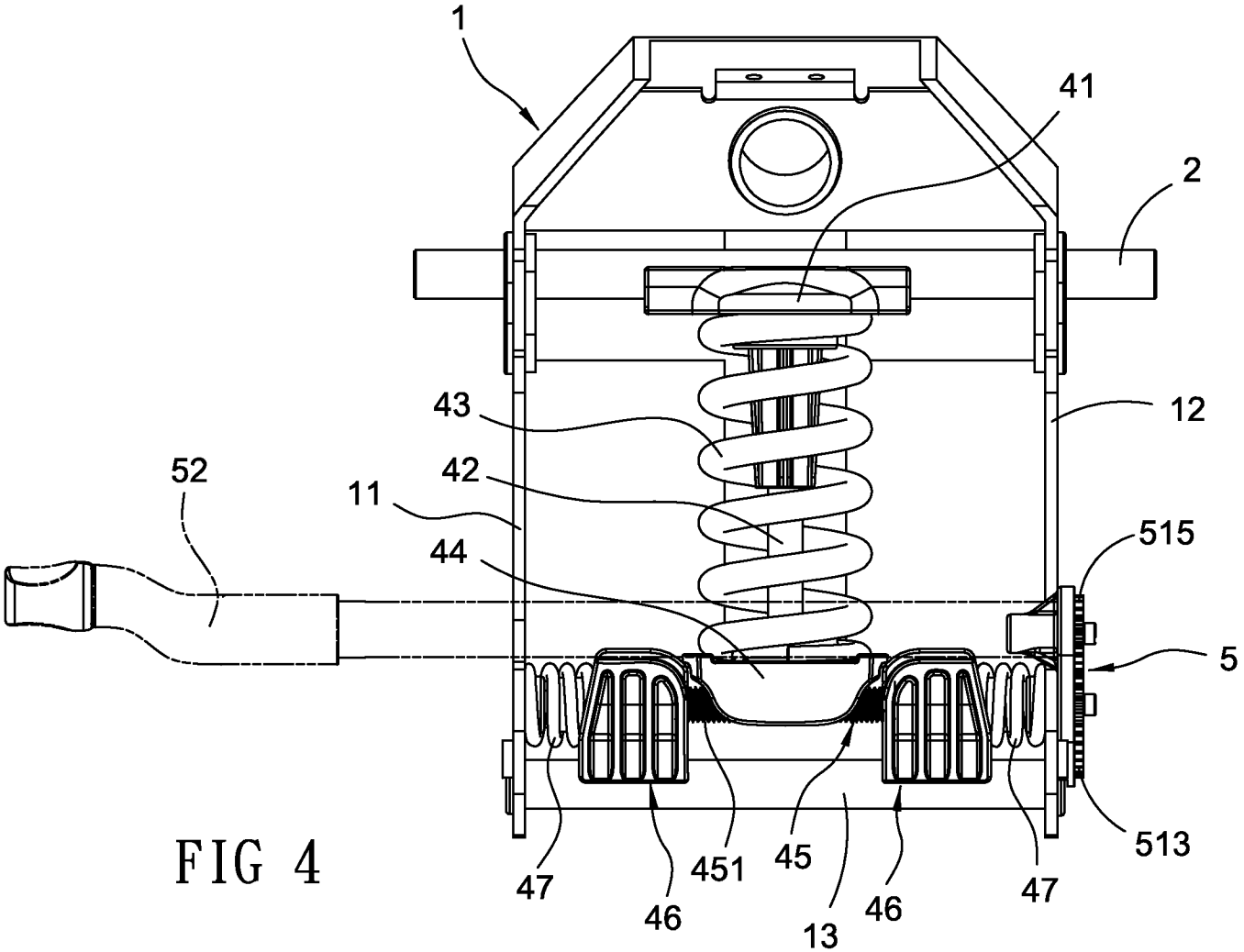
FIG. 4 is a top plan view of the invention showing the unforced first spring.

Please refer to FIGS. 2-4. The flexible adjustment device of the invention includes a hollow seat 1. Two sides of the seat 1 are formed with two parallel and symmetric edge plates 11, 12. The two edge plates 11, 12 are separately provided with two long holes 111, 121. In this embodiment, these long holes 111, 121 are arc-shaped. The two edge plates 11, 12 are separately provided with two through holes 112, 122 and two fixing holes 113, 123. A fixing rod 13 passes through the fixing holes 113, 123. One end of the fixing rod 13 is provided with a plug 131 for allowing to remove the fixing rod 13.

The long holes 111, 121 of the seat 1 is passed through by a first rod 2 connected to a chair back. A length of the long holes 111, 121 is greater than a diameter of the first rod 2 to make the first rod 2 movable therein. A second rod 3 passes through the seat 1 near the first rod 2. In this embodiment, the second rod 3 is placed above the first rod 2. The second rod 3 is used for connecting a chair cushion.

The first rod 2 connects an elasticity set 4. The elasticity set 4 includes a base 41 with a trough 411 abutting against the first rod 2 and a connecting hole 412 receiving an end of a pressing rod 42. The pressing rod 42 is a telescopic tube. The elasticity set 4 further includes a first spring 43. The first spring 43 is axially passed through by the pressing rod 42. An end of the first spring 43 is stopped by the base 41. The other end of the first spring 43 connects a pushing block 44. The pushing block 44 is formed with a connecting tube 441 for connecting the other end of the pressing rod 42. The other end of the first spring 43 presses the pushing block 44. The pushing block 44 is formed with a recess 442 and two arc-shaped shoulders 443 beside the recess 442.

The elasticity set 4 further includes a rotating rod 45 passing through the through holes 112, 122. The rotating rod 45 is formed with two thread sections 451 for separately fastening two pressing blocks 46. Each pressing block 46 has a threaded hole 461 for screwing with the thread section 451. The pressing blocks 46 will linearly move along the rotating rod 45 when the rotating rod 45 is rotated. When the pressing blocks 46 near the center of the rotating rod 45, their protrusions 460 just abut against the shoulders 443 of the pushing block 44. The protrusions 460 are arc-shaped for corresponding to the shoulders 433. Each pressing block 46 is formed with a sliding trough 462 engaging with the fixing rod 13 for supporting the pressing blocks 46 to slide.

The rotating rod 45 passes through two second springs 47. Each second spring 47 is nipped between one of the pressing blocks 46 and one of the edge plates 11, 12 so that the pressing blocks 46 can be pressed by the second springs 47. Finally, the rotating rod 45 further connects a control module 5. The control module 5 includes a chassis 511 with a first link 512 connecting the rotating rod 45. The first link 512 axially connects a first gear 513. The chassis 511 is further disposed with a second link 514. The second link 514 axially connects a second gear 515. The second gear 515 is less than the first gear 513 in diameter. The second gear 515 engages with the first gear 513. The chassis 511 is fastened to the edge plate 12 by screws 516. The chassis 511 is assembled with a cover 517 to cloak the first and second gears 513, 515. The second link 514 connects an adjustment rod 52. The elasticity set 4 can be controlled by rotating the adjustment rod 52.

Figure 5:
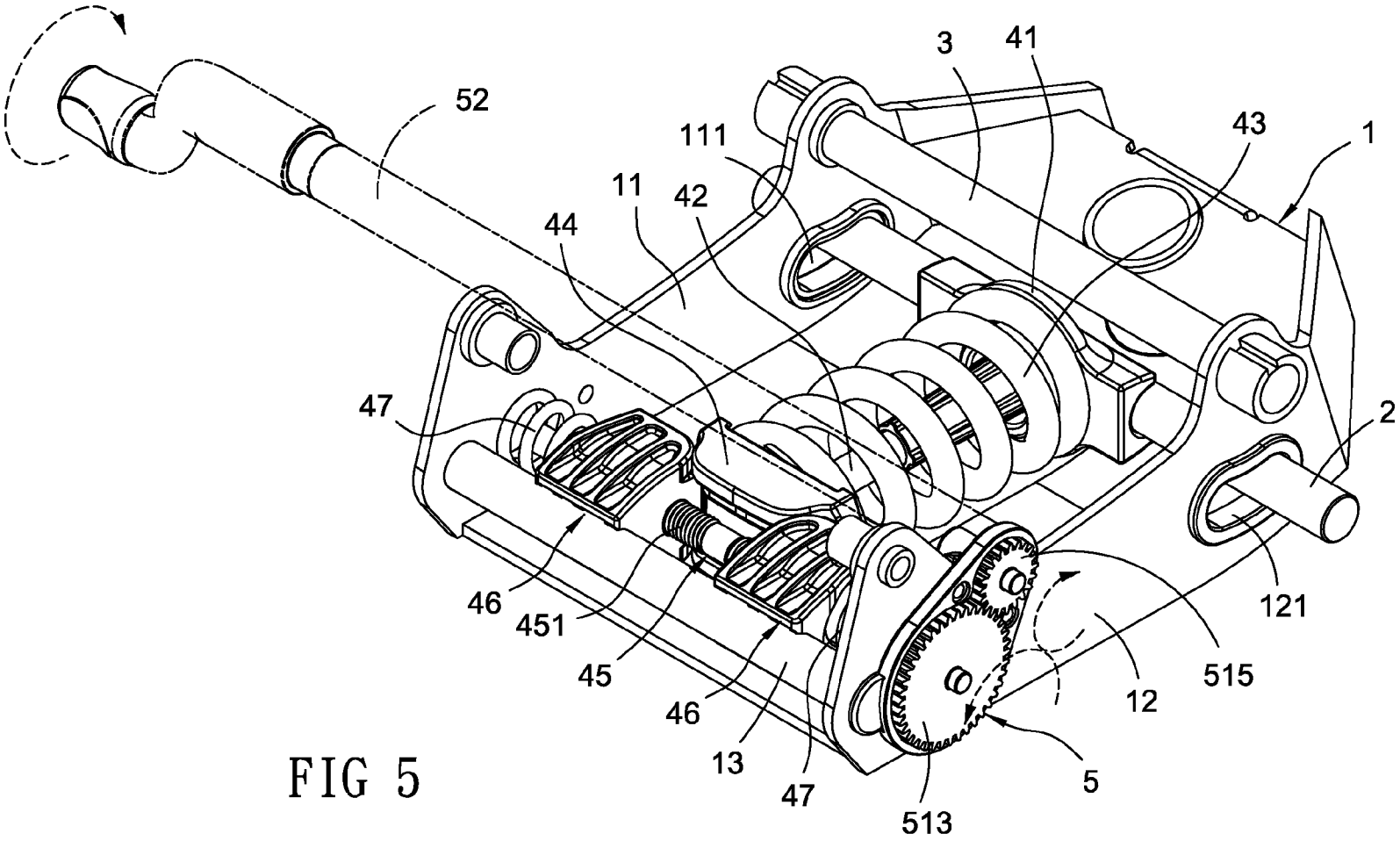
FIG. 5 is a schematic view of the invention in operation.
Figure 6:
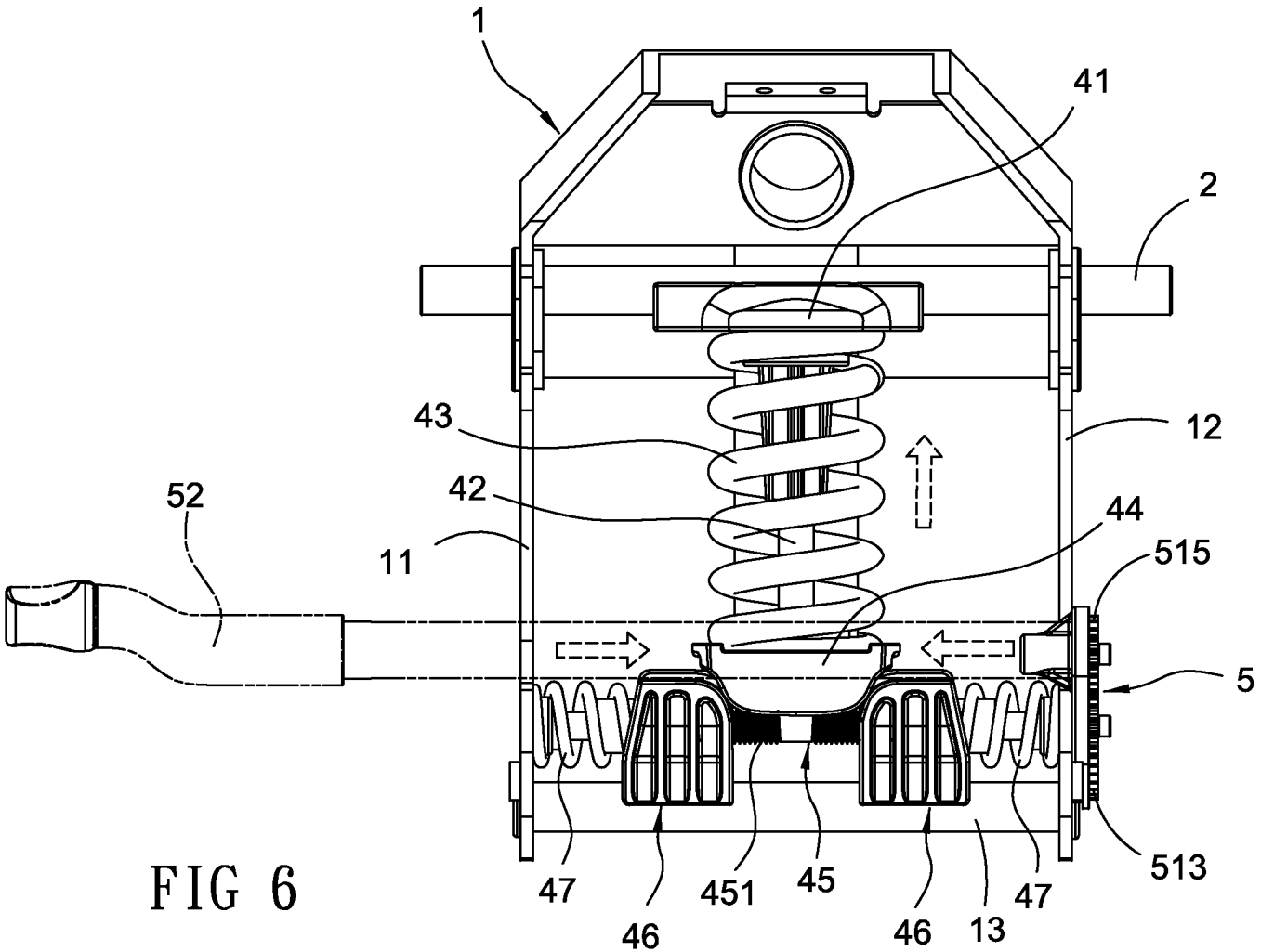
FIG. 6 is a top plan view of the invention showing the forced first spring.

Please refer to FIGS. 5 and 6. To adjust tilt of a chair back, a user can rotate the adjustment rod 52 to drive the control module 5. The adjustment rod 52 drives the second gear 515, the first gear 513 and the rotating rod 45. Because the second gear 515 is less than the first gear 513 in diameter, a user can obtain an effort-saving effect. When the rotating rod 45 begins rotating, the pressing blocks 46 move toward and press the pushing block 44 and then the pressing rod 42 and the first spring 43 are compressed. Thus the compressed first spring 43 will generate stronger elasticity. Meanwhile, the second springs 47 are also compressed by the moving pressing blocks 46 so that the elasticity of the second springs 47 can help a user to save his/her effort. Also, the arc-shaped touch between the protrusions 460 and the shoulders 443 can promote smoothness and reduce friction in operation.

Figure 7:
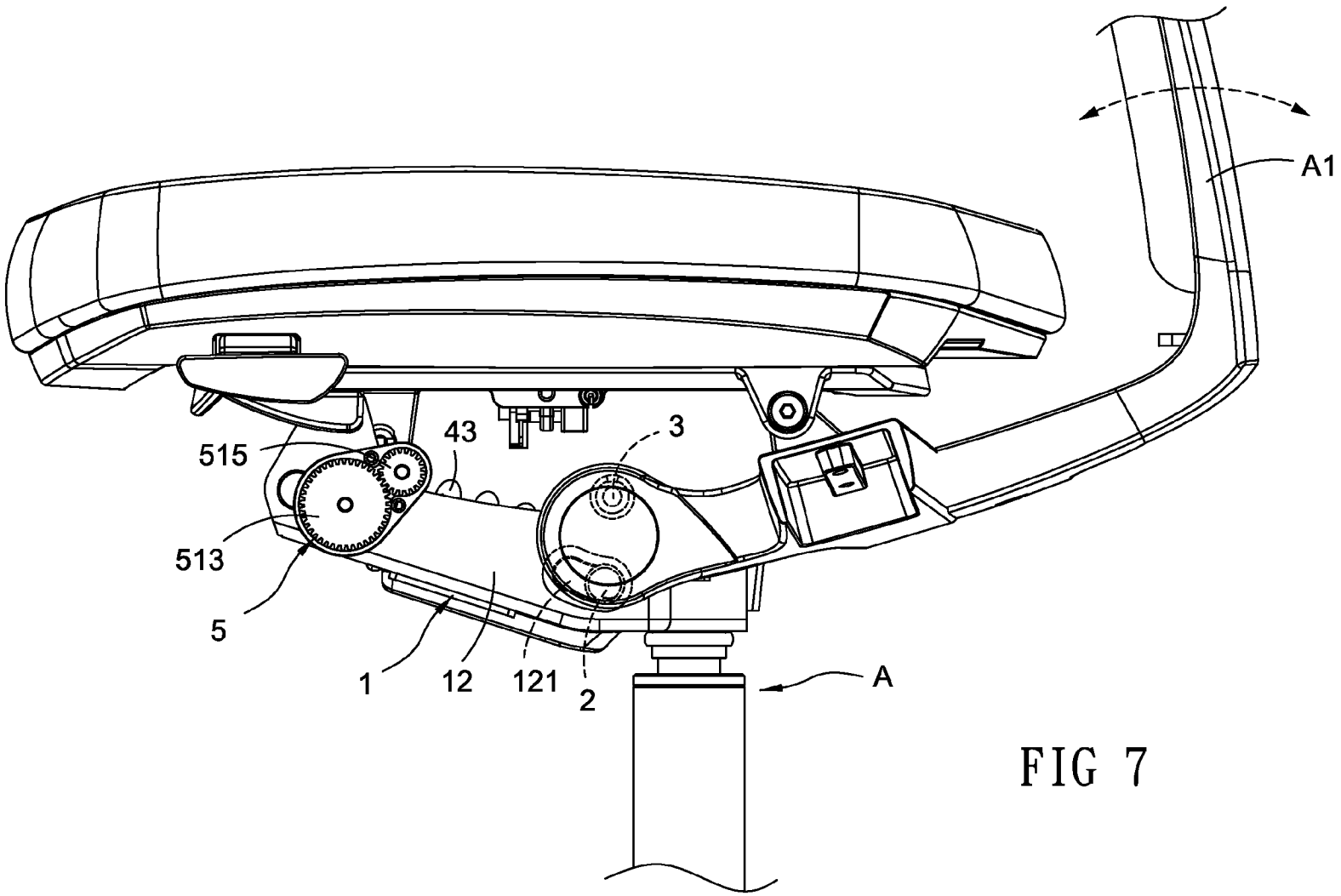
FIG. 7 is a schematic view of the invention assembled in a chair.

On the contrary, when the adjustment rod 52 is reversed to move the pressing blocks 46 away from the pushing block 44, the first spring 43 will be loosen. As shown in FIG. 7, when a user presses a back A1 of a chair A, the first rod 2 slides in the long holes 111, 112 to tilt the back A1 under control to the first spring 43.

What is claimed is:

1. A flexible tilt adjustment device for a chair back, comprising:

a seat, being hollow, having two opposite edge plates, the two edge plates being separately provided with two corresponding longitudinal holes and two through holes;

a first rod, passing through the longitudinal holes;

an elasticity set, disposed in the seat, connected to the first rod, and comprising:

a base, connected to the first rod;

a pressing rod, being telescopic, a first end thereof being connected to the base;

a first spring, axially passed through by the pressing rod, and one end of the first spring being stopped by the base;

a pushing block, connected to a second end of the pressing rod and another end of the first spring; and a rotating rod, passing through the through holes, and formed with two thread sections;

two pressing blocks, each having a threaded hole for being passed by the rotating rod, and separately screwed with the two thread sections; and two second springs, axially passed through by the rotating-rod, nipped between one of the pressing blocks and one of the edge plates; and a control module, connected to the elasticity set, and driving the elasticity set.

2. The flexible tilt adjustment device of claim 1, wherein the two edge plates are separately provided with two fixing holes, and a fixing rod passes through the fixing holes.

3. The flexible tilt adjustment device of claim 2; wherein each pressing block is formed with a sliding trough engaging with the fixing rod.

4. The flexible tilt adjustment device of claim 2, wherein one end of the fixing rod is provided with a plug for allowing to remove the fixing rod.

5. The flexible tilt adjustment device of claim 1, wherein the longitudinal holes are arc-shaped, and a length of the longitudinal holes is greater than a diameter of the first rod.

6. The flexible tilt adjustment device of claim 1, wherein the base is formed with a trough abutting against the first rod and a connecting hole receiving the first end of the pressing rod.

7. The flexible tilt adjustment device of claim 1, wherein the pushing block is formed with a connecting tube for connecting the second end of the pressing rod, and the pushing block is formed with a recess and two arc-shaped shoulders beside the recess so that the pressing blocks abut against the shoulders.

8. The flexible tilt adjustment device of claim 7, wherein each pressing block is formed with a protrusion abutting against the shoulders of the pushing block, and the protrusions are arc-shaped for corresponding to the shoulders.

9. The flexible tilt adjustment device of claim 1, wherein the control module comprises:

a chassis, fixed on one of the edge plates;

a first link, disposed on the chassis, and connecting the rotating rod;

a first gear, axially connected to the first link;

a second link, disposed on the chassis;

a second gear, axially connected to the second link, the second gear is less than the first gear in diameter, and the second gear engages with the first gear; and a cover, assembled with the chassis to cloak the first and second gears.

10. The flexible tilt adjustment device of claim 9, wherein the second link connects an adjustment rod.

* * * * *